United States Patent [19]

Elias

[11] Patent Number: 5,048,250

[45] Date of Patent: Sep. 17, 1991

[54] BUILDING BLOCK

[76] Inventor: Anthony J. P. Elias, P.O. Box 398, Minto, New Brunswick E0E 1J0, Canada

[21] Appl. No.: 502,854

[22] Filed: Apr. 2, 1990

[51] Int. Cl.[5] ..... E04B 1/04; E04B 2/42

[52] U.S. Cl. ..... 52/437; 52/659; 52/606; 106/731

[58] Field of Search ..... 52/444, 437, 438, 612, 52/439, 605, 606, 659; 106/731

[56] References Cited

U.S. PATENT DOCUMENTS

| | | | |
|---|---|---|---|
| 528,636 | 11/1894 | Kupper | 52/437 |
| 852,578 | 5/1907 | Rounds | 52/437 |
| 1,360,183 | 11/1920 | Cosgrove | 52/444 |
| 2,009,547 | 7/1935 | Ginder | 52/438 |
| 2,539,904 | 1/1951 | Hansen | 52/444 |

FOREIGN PATENT DOCUMENTS

| | | | |
|---|---|---|---|
| 345731 | 5/1960 | Switzerland | 52/605 |
| 354237 | 6/1961 | Switzerland | 52/439 |

*Primary Examiner*—James L. Ridgill, Jr.
*Attorney, Agent, or Firm*—George A. Seaby

[57] ABSTRACT

A relatively simple, inexpensive building block for use in self-supporting walls includes a rectangular parallelepipedic body formed of a mixture of three parts by weight cement to two parts by weight wood fiber. Vertically extending grooves and in some cases cylindrical holes are provided in the blocks for defining vertical passages extending the height of the wall for receiving reinforcing rods and/or concrete for strengthening the wall.

4 Claims, 3 Drawing Sheets

BUILDING BLOCK

BACKGROUND OF THE INVENTION

1. FIELD OF THE INVENTION

This invention relates to a building block, and in particular to a building block for use in constructing self-supporting walls.

2. DISCUSSION OF THE PRIOR ART

The building block of the present invention is based on the realization that a relatively simple block can be produced using a mixture of cement and wood fibers. A combination including wood fibers, portland cement and sand is disclosed by Canadian Patent No. 92,204, which issued to E.O. Baylor on Mar. 21, 1905. Moreover, building blocks of the generally the type proposed by the present inventor are disclosed by Canadian Patents Nos. 251,144, which issued to W.E. Nelson on June 30, 1925 and 511,636, which issued to E.A. Stewart et al on Apr. 5, 1955.

GENERAL DESCRIPTION OF THE INVENTION

The object of the present invention is to improve upon existing technology as described by the above-identified patents by providing a relatively simple, inexpensive building block which can be used to produce self-supporting walls having a high insulating value.

Accordingly, the present invention relates to a building block for use in a self-supporting wall comprising substantially rectangular parallelepipedic body means, said body means including a mixture of approximately three parts by weight cement, and two parts by weight wood fiber; and vertically extending groove means in at least one end of said body means for forming a concrete receiving passage with corresponding groove means in a horizontally aligned similar block, whereby a plurality of blocks can be used to form a wall reinforced by concrete columns filling aligned vertical passages in the blocks.

BRIEF DESCRIPTION OF THE DRAWINGS

The invention will be described in greater detail with reference to the accompanying drawings, which illustrate preferred embodiments of the invention, and wherein.

DESCRIPTION OF PREFERRED EMBODIMENT

Figure 1:
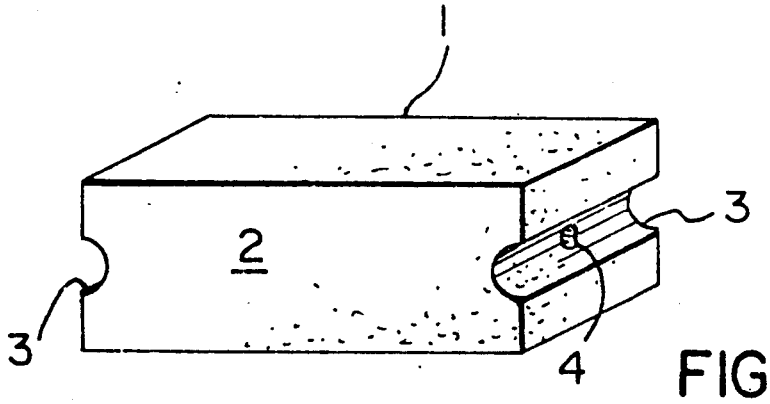
FIG. 1 is a perspective view of a building block in accordance with the invention.

With reference to FIG. 1, a building block 1 in accordance with the invention is formed using cement and wood fiber in a ratio of three parts by weight cement to two parts by weight wood fiber. Virtually any wood can be used to produce the fibers. The wood is shredded in a commercially available shredder to produce long, thin fibers. Sufficient water is added to the cement to produce a readily flowable slurry, and the latter is mixed thoroughly with the wood fibers to produce a mixture.

An example of a mixture produced by the present inventor includes eight pounds of wood fiber, fifteen pounds of cement, one hundred and forty ounces of water and one-half ounce of calcium chloride. The calcium chloride, which is optional, acts as a retardant to delay setting of the cement. The mixture is placed in a mold to produce a block 1.

Figure 2:
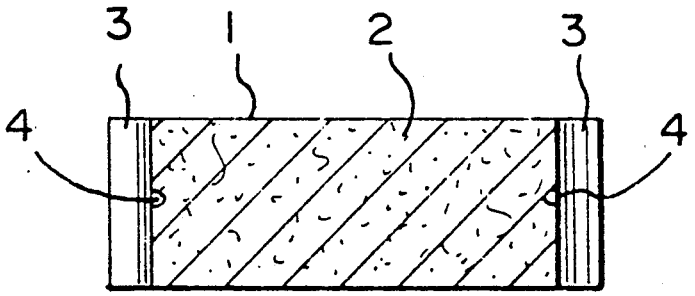
FIG. 2 is a perspective view of a second embodiment of a building block in accordance with the invention.
Figure 5:
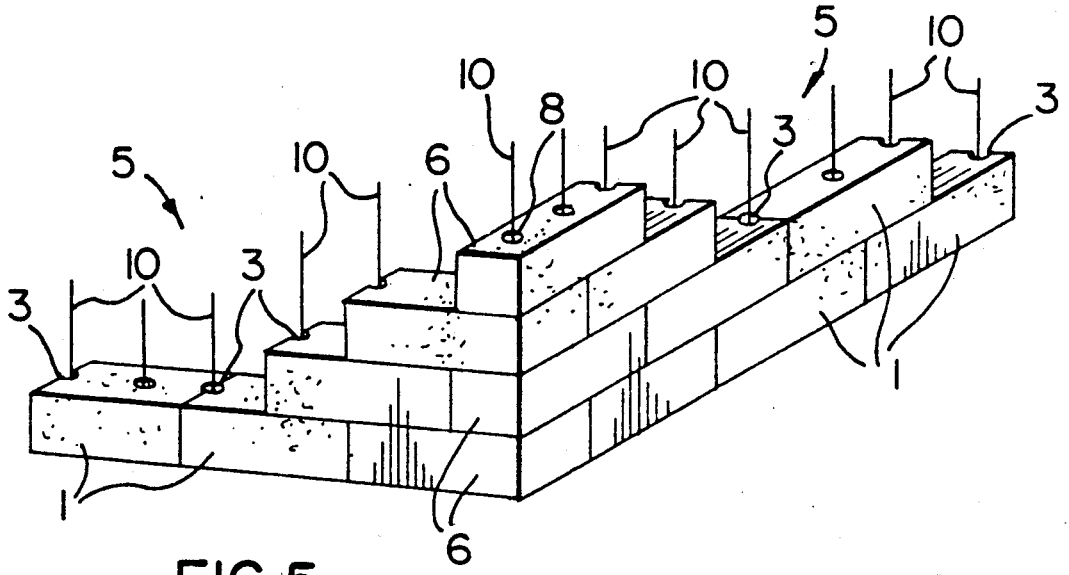
FIGS. 5 and 6 are perspective views of a corner defined by a pair of walls constructed with blocks of the type shown in FIGS. 1 to 3.
Figure 6:
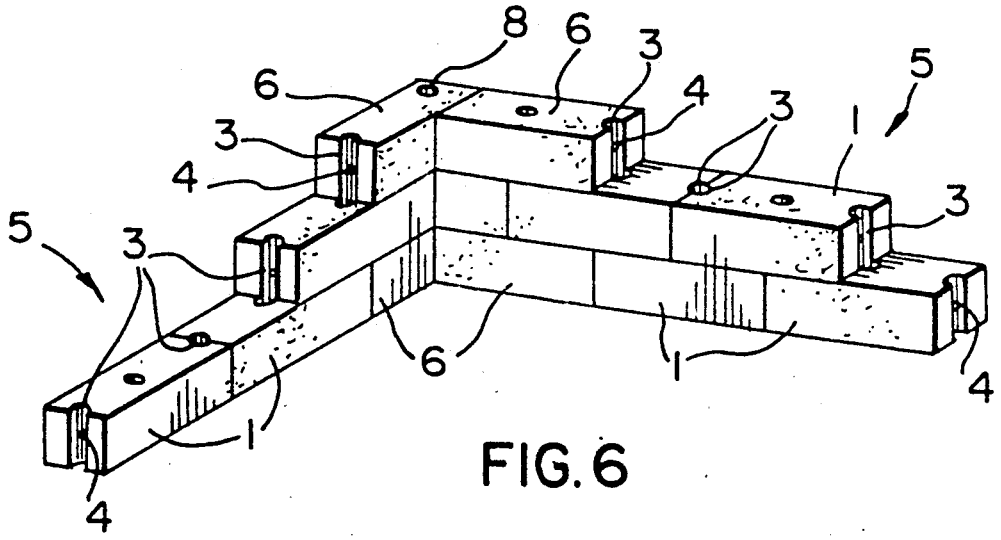

One form of block 1 includes a rectangular, parallelepipedic body 2, with a semi-cylindrical, vertical groove 3 in each end thereof. As best shown in FIG. 2, a small cavity 4 is provided in each groove 3 for receiving mortar, when forming walls generally indicated at 5 (FIGS. 5 and 6). The shape of the grooves 3 are such that when blocks 1 are aligned end to end, a pair of grooves in adjacent blocks 1 define a cylindrical passage for receiving mortar. Mortar entering the cavities 4 results in stronger walls.

Figure 3:
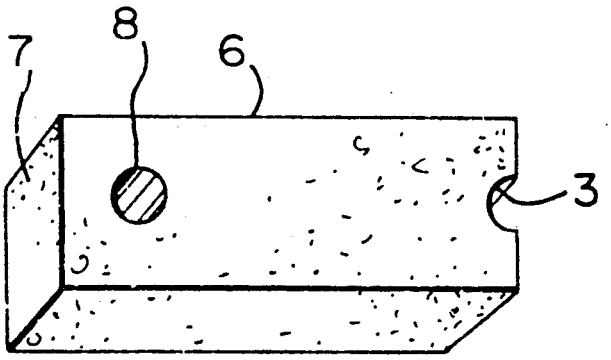
FIG. 3 is a perspective view of a third embodiment of a building block in accordance with the invention.

Referring to FIG. 3, an end block 6 is identical to the block 1, except that the groove 3 in one end 7 is omitted, and a cylindrical vertical hole 8 is provided near the end 7 of the block. It will be appreciated that the end block 6 is used at corners to ensure a smooth outer wall. End blocks 6 are also used to define door and window frames. When used at corners, the holes 8 of corner blocks are aligned for receiving mortar. The end blocks 6 can be replaced at corners by L-shaped blocks (not shown) having semicylindrical grooves in the free ends thereof, and one or more holes extending vertically through the blocks.

Figure 4:
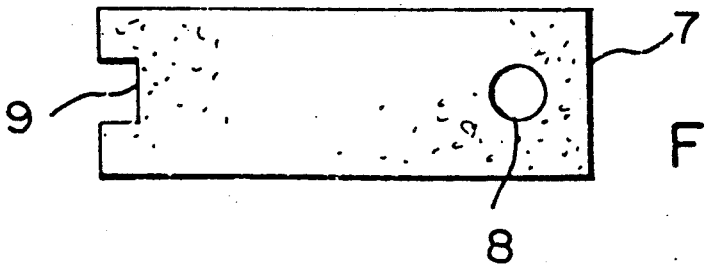
FIG. 4 is a longitudinal sectional view of the block of FIG. 3.

As shown in FIG. 4, the semicylindrical grooves 3 can be replaced by rectangular grooves 9. Rectangular grooves 9 can be used in both ends of a block similar to the block 1, and the round hole 8 can be replaced by a square hole (not shown).

Referring to FIGS. 5 and 6, the blocks 1 and 6 are used to form walls 5 by stacking the blocks in overlapping relationship to form horizontal rows with the grooves 3 and the holes 8 vertically aligned to form passages extending the entire height of the walls. Concrete or mortar is poured into the passages to define columns, which lend lateral strength to the walls. As shown in FIG. 5, metal reinforcing rods 10 can be inserted into the concrete in the passages defined by the grooves 3 and holes 8 to add strength to the walls 5.

Figure 7:
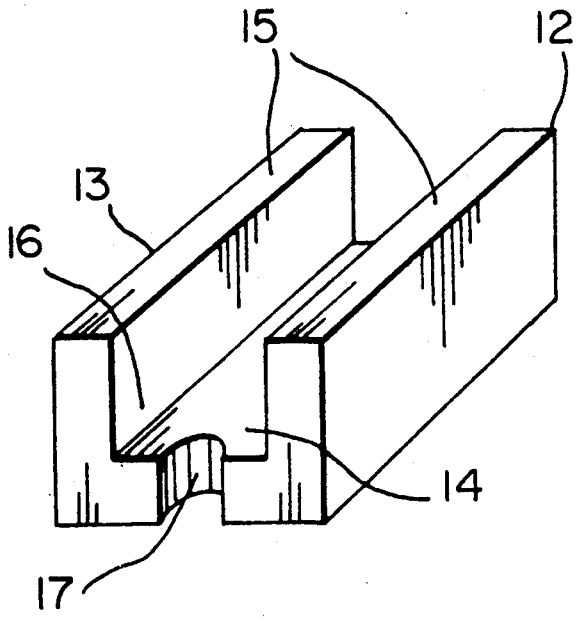
FIG. 7 is a perspective view of a block used to form the top of a wall.

Referring to FIG. 7, a block 12, which can be used as a top course or horizontal row on a wall includes a rectangular body 13 of generally U-shaped cross section. The body 13 includes a bottom wall 14 and side walls 15 defining a rectangular channel 16 for receiving cement and a horizontally disposed, metal reinforcing rod (not shown). Semicylindrical grooves 17 are provided in each end of the bottom wall 14. One or more holes can be provided in the bottom wall 14 for receiving cement and vertical reinforcing rods, or for ventilation purposes.

Figure 8:
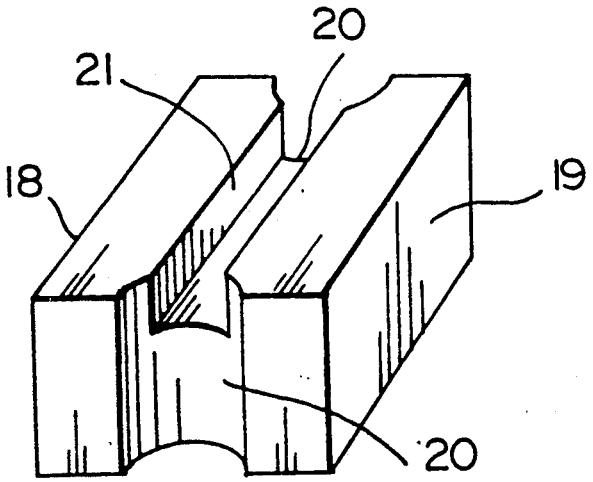
FIG. 8 is a perspective view of a block used on door or window frames.

A somewhat similar block 18 for use in door or window headers is shown in FIG. 8. The block 18 includes a rectangular parallelepipedic body 19 with a semicylindrical vertical groove 20 in each end thereof. Vertical holes (not shown) can also be provided in the body 19 between the ends thereof. A shallow rectangular recess 21 extends the entire length of the top of the body 19 along the longitudinal centre thereof for receiving cement and possibly horizontal reinforcing rods.

It will be appreciated that additional grooves and holes can be provided in the blocks, e.g. in the sides and near both ends of the end blocks for receiving cement or mortar and reinforcing rods. Obviously, additional concrete columns or posts in the walls will lend additional strength thereto. An air hole or holes can be provided in the centres of the blocks for promoting ventilation in a wall. It will also be appreciated that the blocks can be arcuate when viewed from above for use in carried or cylindrical walls.

It has been found that walls formed of building blocks in accordance with the invention have an insulating value of as high as R25. The blocks described above are formed by compressing the mixture of wood fibers and the slurry of cement or mortar into the shapes shown in the drawings. The walls produced with the blocks can readily be covered with stucco, plaster, panels or other finishing materials. The construction of the walls is relatively simple, and the resulting structure is fire-resistant, and has high heat and sound insulating values. With a high insulating value, no additional insulation is required on the interior of the wall which results in reduced building costs. Moreover, the blocks can be used to construct interior room walls in a building. Finally, the walls are strong in terms of lateral stability and load bearing ability.

What is claimed is:

1. A building block for use in a self-supporting wall comprising substantially rectangular parallelepipedic body means, said body means including a mixture of three parts by weight cement and two parts by weight wood fiber; and vertically extending, semicylindrical groove means in at least one end of said body means for forming a cylindrical concrete receiving passage with opposed corresponding groove means in a horizontally aligned similar block, whereby a plurality of blocks can be used to form a wall reinforced by concrete columns filling aligned vertical passages in the blocks.

2. A building block according to claim 1, wherein said body means includes vertically extending groove means in each end thereof.

3. A building block according to claim 1, wherein said body means includes vertically extending groove means in one end thereof, and a vertically extending hole proximate the other end thereof.

4. A building block according to claim 1, 2 or 3, including cavity means in one side of said body means inside said groove means, whereby concrete entering said groove means fills said cavity means to strengthen said columns.

* * * * *